US007576702B2

(12) United States Patent
Yin et al.

(10) Patent No.: US 7,576,702 B2
(45) Date of Patent: Aug. 18, 2009

(54) AUTOMATIC FEEDBACK ADJUSTMENT DEVICE FOR DIGITAL ANTENNA

(75) Inventors: Hsin-Ching Yin, Gangshan Township, Kaohsiung County (TW); Wen-Ming Huang, Dasi Township, Taoyuan County (TW); Wen-Fu Tsai, Renwu Township, Kaohsiung County (TW); Ching-Chun Huang, Taipei (TW); Chi-Wei Hsiao, Jhonghe (TW); Jin-Min Lin, Taipei (TW); Chien-Chih Wang, Taipei (TW)

(73) Assignee: Genesys Logic, Inc., Taipei (TW)

( * ) Notice: Subject to any disclaimer, the term of this patent is extended or adjusted under 35 U.S.C. 154(b) by 276 days.

(21) Appl. No.: 11/798,197

(22) Filed: May 11, 2007

(65) Prior Publication Data

US 2007/0245385 A1 Oct. 18, 2007

(30) Foreign Application Priority Data

Apr. 4, 2006 (TW) ..... 95205625 U

(51) Int. Cl.
*H01Q 3/00* (2006.01)

(52) U.S. Cl. ..... 343/757; 343/760; 725/72

(58) Field of Classification Search ..... 343/757, 343/760; 725/68, 70, 72
See application file for complete search history.

(56) References Cited

U.S. PATENT DOCUMENTS 6,334,218 B1 * 12/2001 Jeong et al. ..... 725/72

7,178,160 B2 * 2/2007 Jeong et al. ..... 725/72

* cited by examiner

*Primary Examiner*—Tan Ho

(57) ABSTRACT

An automatic feedback adjustment device for a digital antenna includes a digital antenna unit, a trafficator, a tuner, a demodulator, an antenna direction driver unit, a secondary controller, and a primary controller. The digital antenna unit is a digital video/broadcasting antenna system. The trafficator is connected to the digital antenna unit to retrieve direction data associated with the actual elevation angle and direction. The tuner is connected to the digital antenna unit and the demodulator is connected to the tuner in order to receive and convert a transmission signal from a transmission terminal into the video data and a received-signal quality signal. The antenna direction driver unit is connected to the digital antenna unit in order to drive adjustment of direction and elevation angle of the antenna. The secondary controller is connected to the trafficator, the demodulator and the antenna direction driver unit to receive the data of the actual antenna direction, the video data, and the received-signal quality signal and supplies an antenna drive signal. The primary controller is connected to the Internet, the storage device and secondary controller to retrieve and store the optimum direction and elevation angle for the antenna to receive signals and analyze and calculate data of the optimum signal receiving direction for the secondary controller and the secondary controller drives the antenna direction drive unit to control the digital antenna unit to automatically adjust to the optimum receiving direction.

9 Claims, 6 Drawing Sheets

AUTOMATIC FEEDBACK ADJUSTMENT DEVICE FOR DIGITAL ANTENNA

BACKGROUND OF THE INVENTION

1. Field of the Invention

The present invention generally relates to an automatic feedback adjustment device for a digital antenna, and in particular to the adjustment of receiving direction and elevation angle for a digital antenna unit that is based on closed-loop feedback of actual direction of the digital antenna to automatically perform adjustment to the optimum receiving direction.

2. The Related Arts

Digital television (DTV) and digital audio broadcasting (DAB) have founded the new era for multimedia home entertainment. In particular, the digital television and the digital audio broadcasting have become available to homes, allowing human to receive information from a wide range of channels. However, the conventional DTV and DAB systems both need a digital antenna unit to receive signals, such as a plate shaped satellite antenna of DVB-S (Digital Video Broadcasting-Satellite) and receiving antennas of DVB-T (Digital Video Broadcasting-Terrestic) and ATSC (Advanced Television Systems Committee). All of these have to be adjusted manually to the best/optimum receiving direction, and through the observation of the receiving signal quality through the naked human eye, to manually adjust the digital antenna unit to its best direction and elevation angle.

However, the conventional digital antenna unit adjusted manually to the optimum receiving elevation angle and direction costs more time and labor, and the adjustment of the optimum direction may change from time to time because of the orbital positions of artificial satellites, the climate, the global tides, the magnetic fields, the sun spot and other affecting factors. And this makes it necessary to adjust the digital antenna unit to the optimum receiving direction manually over and over again, making the adjustment of the digital antenna unit extremely hard and inconvenient.

Further, considering of attaching an electric motor unit to the digital antenna unit used to adjust the direction and elevation angle of the digital antenna unit, although using the electric motor to drives the adjustment of the direction and elevation angle for the digital antenna unit can improve over the manual adjustments, but it cannot adjust the optimum receiving position of digital antenna unit quickly and accurately.

In the previous references, for example Taiwan Utility Model No. M285858 discloses a rotation adjustment device of satellite antenna, and Taiwan Patent No. I246793 discloses an angle adjustment device and a satellite antenna having the angle adjustment device, both presenting conventional manually adjusted satellite antenna device. These conventional devices need to be manually adjusted to the optimum receiving direction.

In addition, Taiwan Patent No. M264673 discloses a transmission device that performs automatic adjustment based on signals received from a satellite. However, the reference did not mention the method for adjusting to the optimum receiving position, and instead, it still needs to be adjusted to the optimum receiving position by human hands.

Taiwan Patent No. I251374 discloses a system and a method that automatically adjust an antenna to a position corresponding to the highest intensity of signal. However, the system and the method requires a transmitting signal to be transmitted to an antenna device first and the antenna device then creates a main wave beam, constantly changing phase of the transmitting signal to change the direction of the main wave beam and scan the main wave beam through all directions to identify the direction of a wireless-signal user end, and adjusting the strongest part of the main wave beam to point to user position, allowing the user to receive better receiving quality. This system and method takes more time to search and scan, and the user end antenna is in fixed condition, rather than being automatically adjustable. Whether the user end antenna can really receive the strongest receiving signal is not promised, and meanwhile, this system and method is limited to a wireless area network system in a specific space, not suited for the adjustment of the typically known digital video/broadcasting receiving antenna.

SUMMARY OF THE INVENTION

Thus, a first objective of the present invention is to provide an automatic feedback adjustment device for a digital antenna, comprising a trafficator, which is connected to a digital antenna unit to automatically retrieve a feedback on an actual direction and elevation angle from the digital antenna unit.

A second objective of the present invention is to provide an automatic feedback adjustment device for a digital antenna, comprising an antenna direction driver unit, a secondary controller and a primary controller, wherein the antenna driver unit is connected to the digital antenna unit to drive the adjustment of the direction and the elevation angle of the digital antenna unit; the secondary control is connected to the trafficator to receive the feedback of the actual direction and elevation angle of the digital antenna unit from the trafficator; and the secondary controller is also connected to the primary controller, whereby the primary controller calculate and output the optimum signal receiving direction of the digital antenna unit to the secondary controller to allow the secondary controller to accurately drive the digital antenna unit to the optimum direction and elevation angle.

A third objective of the present invention is to provide an automatic feedback adjustment device for a digital antenna, wherein the primary controller is connected to a network, such as the Internet, and/or a storage device in order to obtain data of the optimum direction and elevation angle for a transmission terminal of a satellite or a transmission antenna so that the primary controller can quickly and accurately calculate and decide the optimum direction and elevation angle of the digital antenna unit.

A fourth objective of the present invention is to provide an automatic feedback adjustment device for a digital antenna, comprising a tuner and a demodulator, wherein the tuner is connected to the digital antenna unit and the demodulator is connected to the tuner and the secondary controller in order to receive a transmission signal from the transmission terminal and convert the signal into video data and signal intensity data for the secondary controller, which is used to decide the feedback of the transmission signal intensity to serve as the basis on which the primary controller drives the digital antenna unit to the optimum signal receiving position.

To realize the above objectives, an automatic feedback adjustment device for a digital antenna provided by the present invention comprises a digital antenna unit, a trafficator, a tuner, a demodulator, an antenna direction driver unit, a secondary controller, and a primary controller. The digital antenna unit is a digital video/broadcasting antenna system. The trafficator is connected to the digital antenna unit to retrieve direction data associated with the actual elevation angle and direction. The tuner is connected to the digital antenna unit and the demodulator is connected to the tuner in order to receive and convert a transmission signal from a transmission terminal into the video data and a received-signal quality signal. The antenna direction driver unit is connected to the digital antenna unit in order to drive adjustment of direction and elevation angle of the antenna. The secondary controller is connected to the trafficator, the demodulator and the antenna direction driver unit to receive the data of the actual antenna direction, the video data, and the received-signal quality signal and supplies an antenna drive signal. The primary controller is connected to the Internet, the storage device and secondary controller to retrieve and store the optimum direction and elevation angle for the antenna to receive signals and analyze and calculate data of the optimum signal receiving direction for the secondary controller and the secondary controller drives the antenna direction drive unit to control the digital antenna unit to automatically adjust to the optimum receiving direction in order to complete the objectives of the present invention for quickly and accurately adjusting the digital antenna to the optimum receiving position.

BRIEF DESCRIPTION OF THE DRAWINGS

In order to clearly show and make better comprehension of these and other features and advantages of the present invention, the present invention will now be described by way of examples, with reference to a preferred embodiment illustrated in the drawings, in which.

DETAILED DESCRIPTION OF THE PREFERRED EMBODIMENTS

Figure 1:
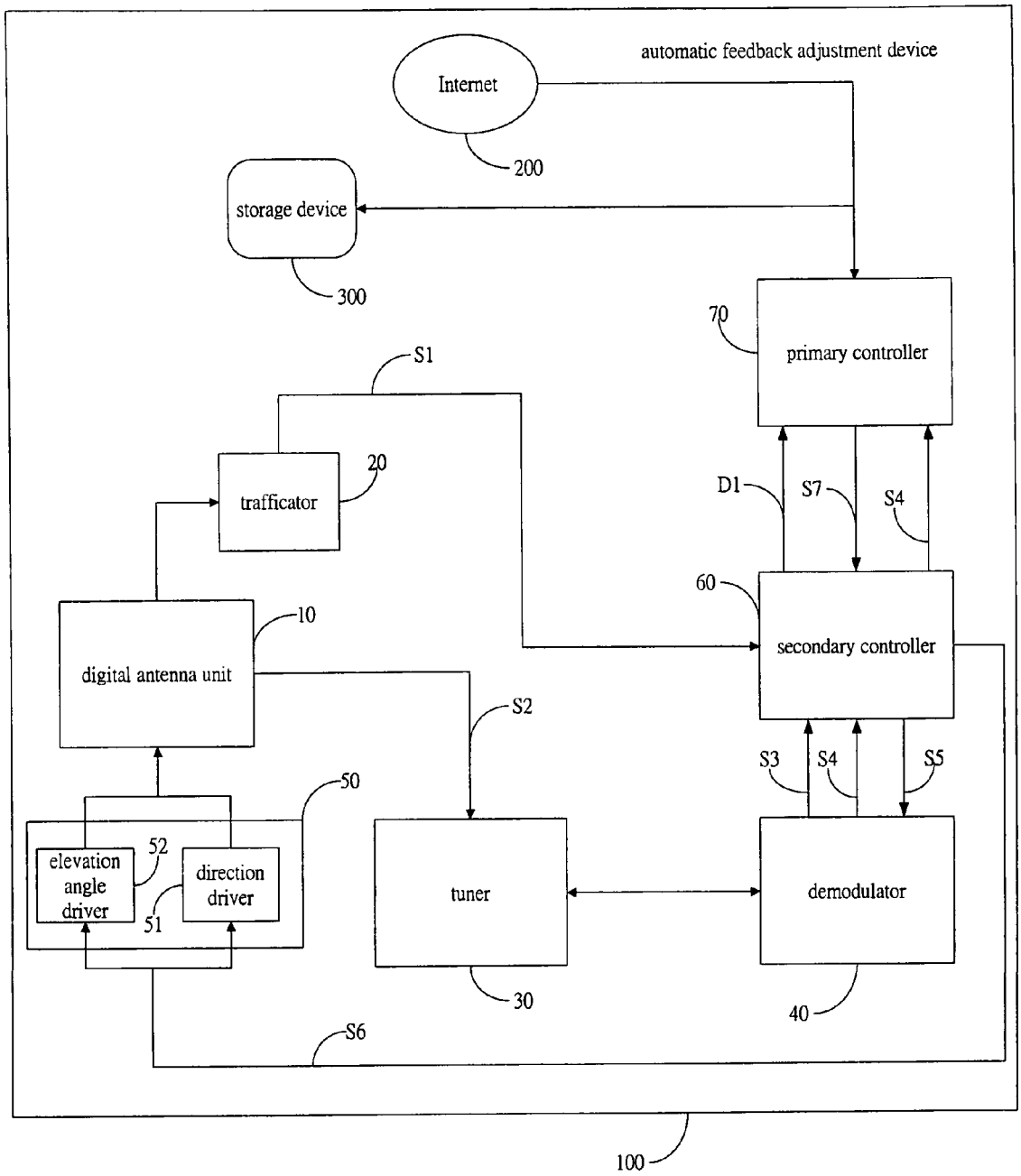
FIG. 1 shows a system block circuit diagram of an automatic feedback adjustment device in accordance with a first embodiment of the present invention.

With reference to the drawings and in particular to FIG. 1, an automatic feedback adjustment device for a digital antenna in accordance with the present invention, generally designated with reference numeral 100 is shown. The automatic feedback adjustment device 100 comprises a digital antenna unit 10, a trafficator 20, a tuner 30, a demodulator 40, an antenna direction drive unit 50, a secondary controller 60, and a primary controller 70. The digital antenna unit 10 is a digital video and broadcasting antenna unit, for example a DVB-S disk satellite antenna, a receiving antenna for DVB-T system and ATSC system.

Figure 2:
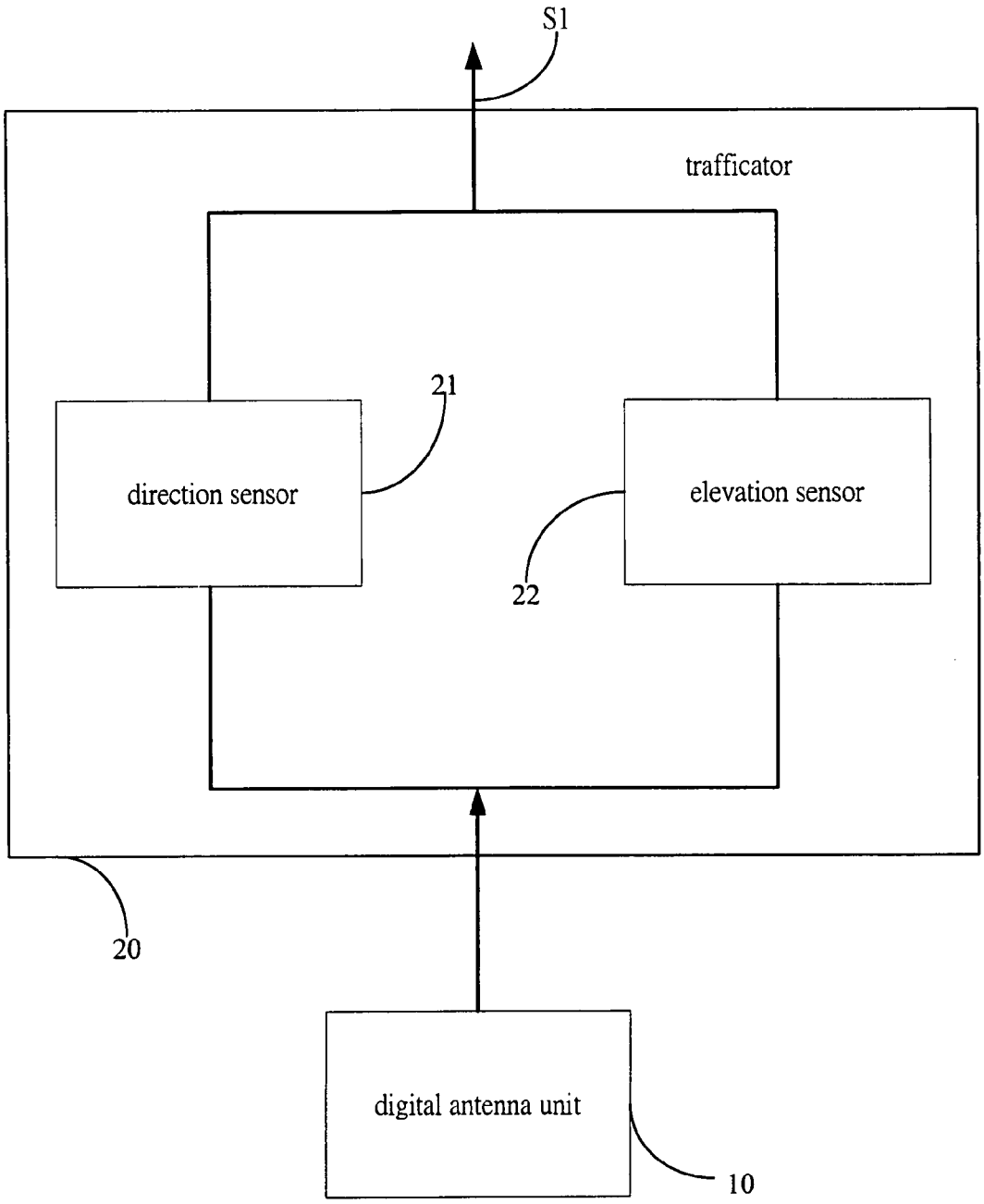
FIG. 2 shows a detailed block diagram of a trafficator of the automatic feedback adjustment device of the present invention illustrated in FIG. 1.

Also referring to FIG. 2, the trafficator 20 is connected to the digital antenna unit 10, in order to retrieve data of orientation including actual direction and elevation angle of the digital antenna unit 10. The trafficator 20 is not limited and specific type and, in the embodiment illustrated, the trafficator 20 comprises a direction sensor 21 and an elevation sensor 22, respectively detecting the actual direction and the elevation of the digital antenna unit 10, and generates a direction signal S1. The direction sensor 21 and elevation sensor 22 can be embodied as photo-electrical sensors, and it is apparent that other direction or elevation sensor or indicators are also applicable in the present invention and are considered within the scope of the present invention.

The tuner 30 is connected to the digital antenna unit 10, in order to select channels and receive a transmission signal S2 from an artificial satellite, a digital TV station, and/or a digital broadcast station through the digital antenna unit 10.

The demodulator 40 is connected to the tuner 30, in order to control the operation of receiving channel for the tuner 30 and demodulate the transmission signal S2 that the tuner 30 receives into a digital video image signal S3 and a signal intensity quality signal S4 for output.

The antenna direction drive unit is connected to the digital antenna unit 10, in order to drive the adjustment of direction and elevation for digital antenna unit 1. The antenna direction drive unit 50 is not limited to any specific type and, in the embodiment illustrated, comprises a direction driver 51 and an elevation angle driver 52. The direction driver 51 drives the adjustment of direction for the digital antenna unit 10, and the elevation angle driver 52 drives the adjustment of elevation angle for the digital antenna unit 10. The direction driver 5 and the elevation angle driver 52 are server motor systems that employ server motors to drive the adjustment of direction and elevation angle for the digital antenna unit 10. Apparently, other equivalent driver units, such as electromagnet based devices or power devices, are also applicable in the present invention.

Figure 3:
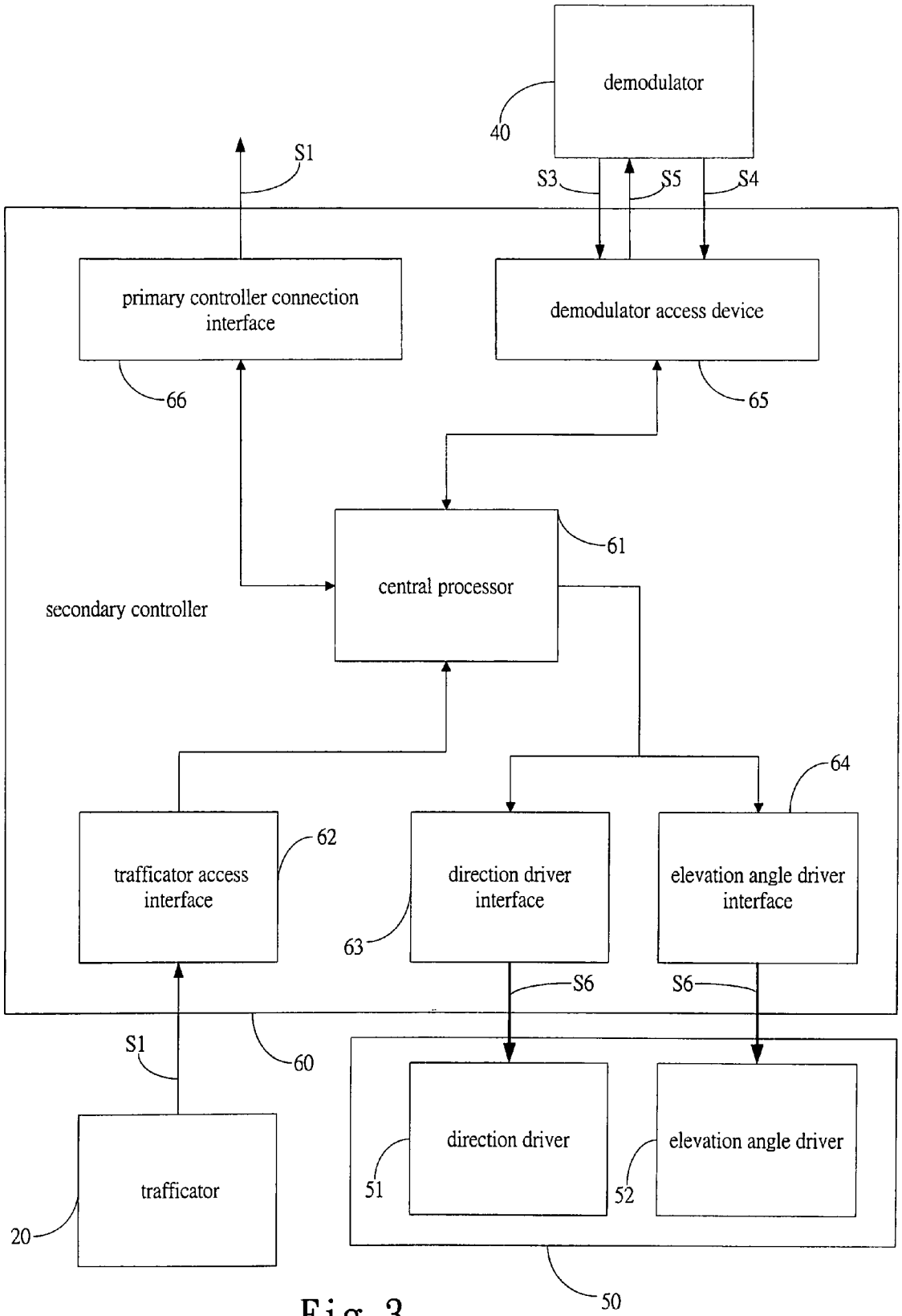
FIG. 3 shows a detailed block diagram of a secondary controller of the automatic feedback adjustment device of the present invention illustrated in FIG. 1.

Also referring to FIG. 3, the secondary controller 60 is connected to the trafficator 20, the demodulator 40, and the antenna direction drive unit 50. The secondary controller 60 receives the direction signal S1 from the trafficator 20 to obtain data of direction and elevation angle associated with the digital antenna unit 10. The secondary controller 60, also, receives from demodulator 40 the digital video image signal S3 and the signal intensity quality signal S4. The secondary controller 60 at the same time transmits a control signal S5 to the demodulator 40, as reference for demodulator 40 and tuner 30 to control the operation.

The secondary controller 60 transmits a drive control signal S6 to the antenna direction driver 50 to control the direction driver 51 and the elevation angle driver 52 of the antenna direction drive unit 50 so as to control the operation of driving the adjustment in direction and elevation angle of the digital antenna unit 10.

The secondary controller 60 is not limited to any specific type and, in the embodiment illustrated, the secondary controller 60 includes a central processor 61, a trafficator access interface 62, a direction driver interface 63, an elevation angle driver interface 64, a demodulator access device 65, and a primary controller connection interface 66. The control processor 61 serves as a processing center for the digital video image signal S3, the direction signal S1, and the signal intensity quality signal S4, and also functions as an output control center for the control signal S5 and the drive control signal S6. The trafficator access interface 62 is connected between the trafficator 20 and the central processor 61 in order to receive, convert, and feed the direction signal S1 from the trafficator 20 into the central processor 61.

The direction driver interface 63 is connected between the direction driver 51 of the antenna direction drive unit 50 and the central processor 61 and the elevation angle driver connects between the elevation angle driver 52 of the antenna direction drive unit 50 and the central processor 61 so that they can use the direction control signal S6 to control the direction driver 51 and elevation angle driver 52 to drive the adjustment of direction and elevation angle for the digital antenna unit 10.

The demodulator access interface 65 is connected between the demodulator 40 and the central processor 61 in order to supply the digital video image signal S3 and signal intensity quality signal S4 from the demodulator 40 to the central processor 61 and to allow the control signal S5 produced by the central processor 61 to be transmitted to the demodulator 40.

The primary controller connection interface 66 is connected to the central processor 61 in order to output a teleview image data D1 that is converted from the digital video image signal S3 by the central processor 61, the signal intensity quality signal S4, and the direction signal S1. The primary controller connection interface 66 is not limited to any specific type and examples include an USB interface, an IEEE1394 interface, a PCI Express interface, and a wireless transmission interface, as well as other equivalent device known in the related field of art.

The primary controller 70 is connected to the Internet 200, a storage device 300, and the secondary controller 60. The primary controller 70 that are connected to the Internet 200 and the storage device 300 receive, from the Internet 200, data of optimum direction and elevation angle of the antenna for receiving signals from a transmission terminal, such as an artificial satellite, a digital video TV station, and a digital broadcasting station, for controlling the direction and elevation angle of the digital antenna unit 10. The storage device 300 stores video data recording and saving the data of optimum direction and elevation angle for the digital antenna unit 10. The storage device 300 is not limited to any specific type and can be a storage medium of for example a USB-interfaced portable storage device, an IDE-interfaced hard disk drive, and a readable/writable optic disk drive.

Based on the optimum direction and elevation angle of the digital antenna unit 10 obtained from the Internet 200 and/or the storage device 300, the primary controller 70 sends out an antenna control signal S7 to the secondary controller 60 and receives the teleview image data D1, the signal intensity quality signal S4, and the direction signal S1 from the secondary controller 60, and converts the teleview image data D1, the signal intensity quality signal S4, and the direction signal S1 into digital video format, for example image data, signal intensity quality data, and direction data in MPEG2 format, stored in the storage device 300.

Figure 4:
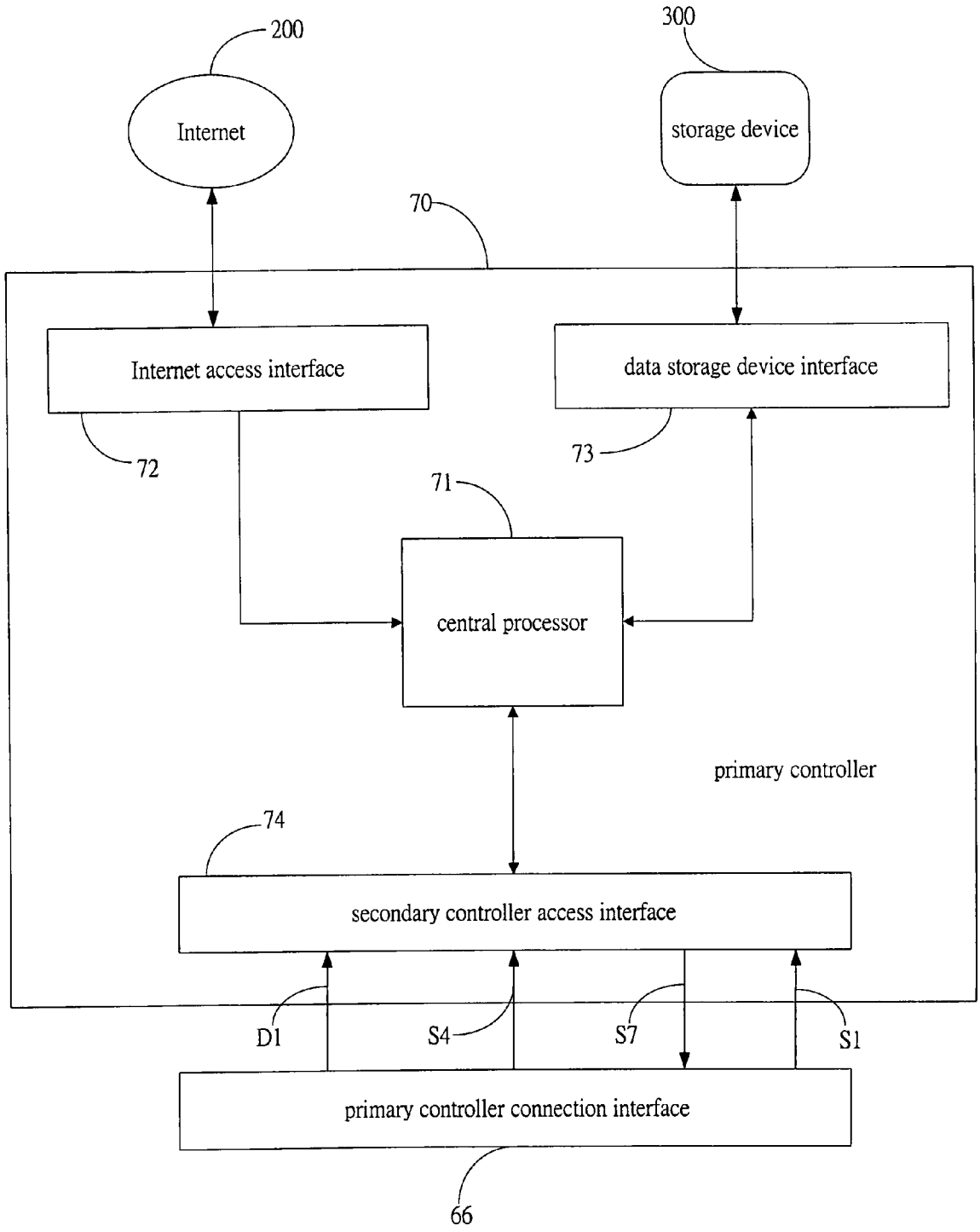
FIG. 4 shows a detailed block diagram of a primary controller of the automatic feedback adjustment device of the present invention illustrated in FIG. 1.

Referring to FIG. 4, the primary controller 70 is not limited to any specific type and, in the embodiment illustrated, comprises a central processor 71, an Internet access interface 72, a data storage device interface 73, and a secondary controller access interface 74. The central processor 71 provides conversion and processing of the teleview image data D1, the signal intensity quality signal S4, and the direction signal S1 and controls the output of the antenna control signal S7. The Internet access interface 72 is connected between the central processor 71 and the Internet 200 for receiving, through the Internet 200, data of optimum direction and elevation angle of the antenna for receiving signals from a transmission terminal, such as an artificial satellite, a digital TV station, and a digital broadcasting station. The data storage device interface 73 is connected to the central processor 71 and the storage device 300, so that the data storage device interface 73 can save video data, signal intensity quality data, direction data and the optimum antenna direction and elevation angle for a transmission terminal like the artificial satellite, the digital TV station, and the digital broadcasting station.

The secondary controller access interface 74 is connected to the central processor 71 and the primary controller connection interface 66 of the secondary controller 60 in order to receive the teleview image data D1, the signal intensity quality signal S4, and the direction signal S1 from the secondary controller 60 and output the antenna control signal S7 to the secondary controller 60. The secondary controller access interface 74 is not limited to any specific type and can be, for example, a USB interface, an IEEE1394 interface, a PCI_E interface, and a wireless transmitting interface. Other equivalent devices are also considered within the scope of the present invention.

Figure 5:
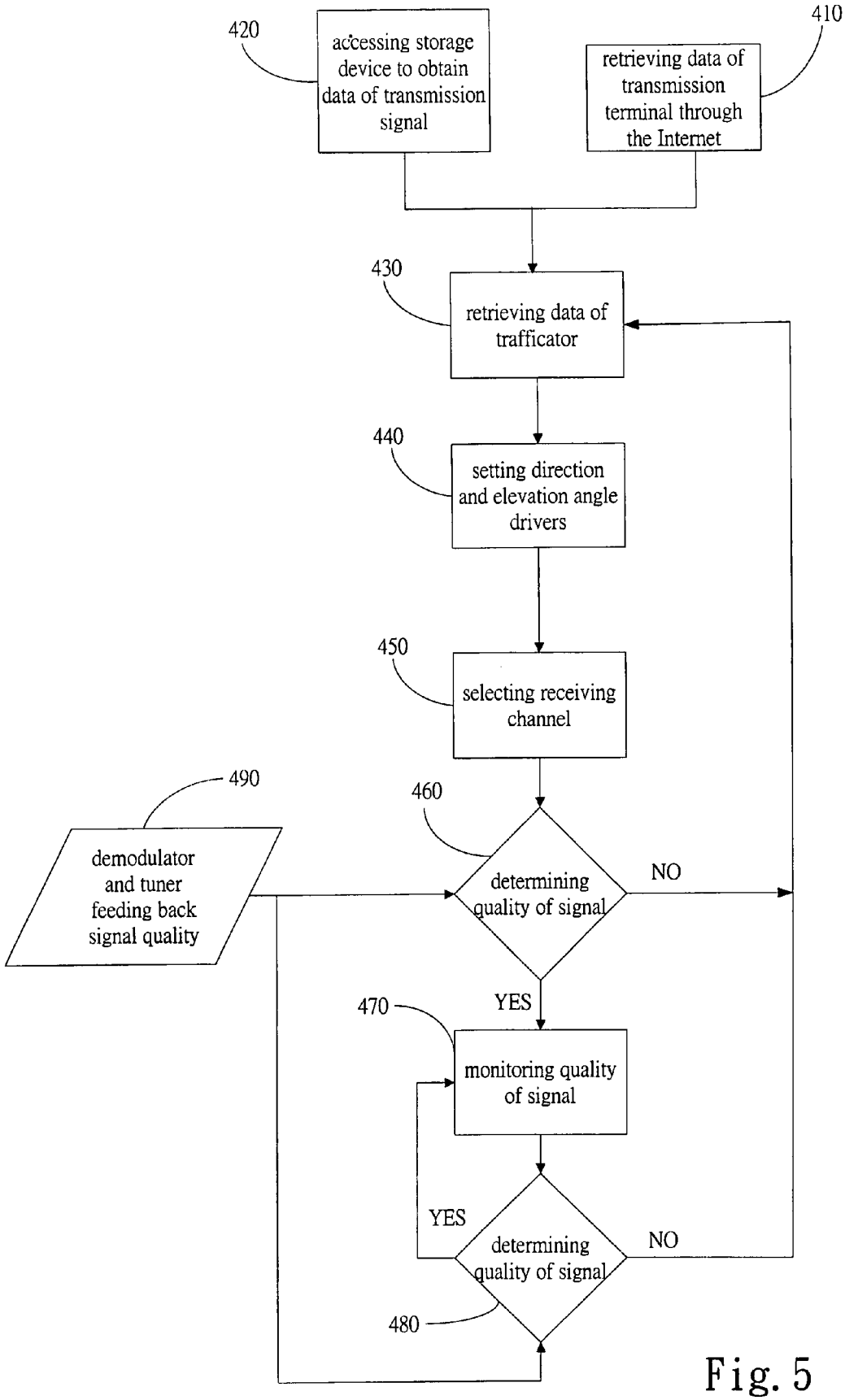
FIG. 5 shows a flowchart of the operation of the automatic feedback adjustment device of the present invention.

Referring to FIG. 5, a flow chart of the operation of the adjustment device 100 in accordance with the presented invention is shown, comprising the followings steps 410-490, wherein:

Step 410: retrieving data of transmission terminal through the Internet, which is carried out by the primary controller 70 retrieving, through the Internet 200, optimum antenna direction and elevation angle for the transmission terminal of an artificial satellite, a digital TV station, and a digital broadcasting station;

Step 420: accessing storage device to obtain data of transmission signal, wherein the primary controller 70 retrieves data of optimum direction and elevation angle of an antenna receiving signals from a transmission terminal, such as an artificial satellite, a digital TV station, and a digital broadcasting station, which is stored in the storage device 300;

Step 430: retrieving data of trafficator, wherein the trafficator 20 retrieves the direction signal S1 that contains the actual direction and elevation angle of the digital antenna unit 10;

Step 440: setting direction and elevation angle drivers, wherein the primary controller 70, based on the optimum direction and elevation angle for antenna receiving signals from transmission terminal of for example an artificial satellite, a digital TV station, and a digital broadcasting station and the direction signal S1 that are obtained in Steps 410, 420, 430, carries out calculation to provide the antenna control signal S7 to the secondary controller 60, and wherein the secondary controller 60 controls the direction driver 51 and the elevation angle driver 52 of the antenna direction driver unit 50 in order to set the direction and the elevation angle adjustments for the digital antenna unit 10;

Step 450: selecting receiving channel, wherein the secondary controller 60 controls the demodulator 40, and the demodulator 40 in turn controls the tuner 30 to select the desired digital video or broadcasting channel;

Step 460: determining quality of signal, wherein the quality of signal received is inspected, and when good quality of signal is ensured, the process goes to Step 470; otherwise, the process goes back to Step 430;

Step 470: monitoring quality of signal, wherein the demodulator 40, based on the intensity of signal received by the digital antenna unit 10 from the transmission signal, supplies the signal intensity quality signal S4 to the secondary controller 60, and the secondary controller 60 in turn sends the signal intensity quality signal S4 to the primary controller 70 in which the signal is converted into data of signal intensity for monitoring;

Step 480: determining quality of signal, wherein the quality of signal received is inspected, and when good quality of signal is ensured, the process goes to Step 470; otherwise, the process goes back to Step 430; and Step 490: demodulator and tuner feeding back signal quality, wherein the demodulator 40 and the tuner 30, based on the signal intensity received by the digital antenna unit 10 from the transmission terminal, supplies the signal intensity quality signal S4 to the secondary controller 60, and the secondary controller 60 in turn sends the signal intensity quality signal S4 to the primary controller 70 in which the signal is converted into data of signal intensity for feedback.

Steps 410 to 490 of the process described in FIG. 5 may comprise software and control programs that pre-loaded in the central processor 61 of the secondary controller 60 and the central processor 71 of the primary controller 70.

Figure 6:
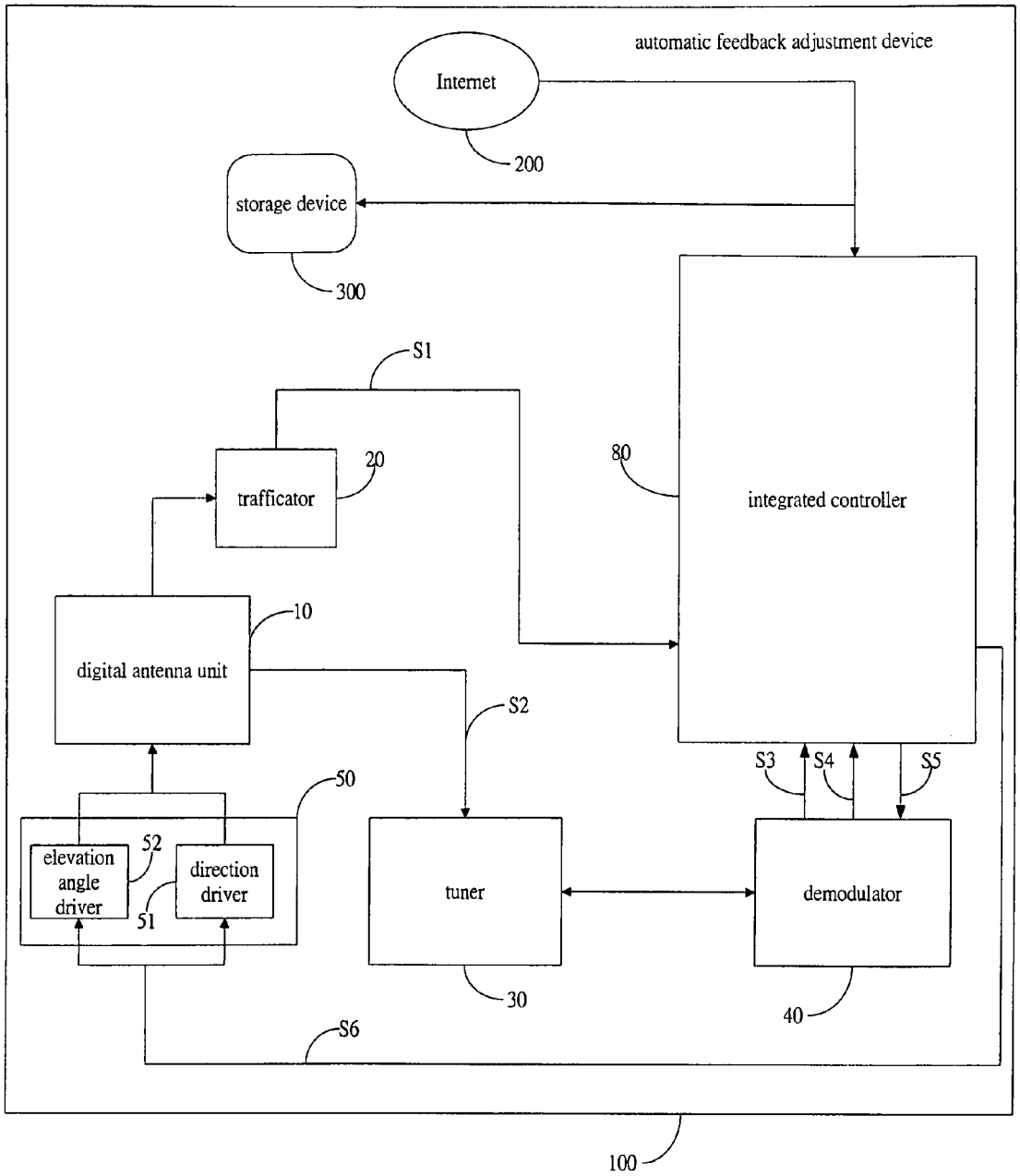
FIG. 6 shows a system block circuit diagram of an automatic feedback adjustment device in accordance with a second embodiment of the present invention.

With reference to FIG. 6, an adjustment device 100 in accordance with a second embodiment of the present invention is shown, in which the secondary controller 60 and the primary controller 70 are integrated in to one single integrated controller 80, and the integrated controller 80 can substitute the secondary controller 60 and the primary controller 70 providing the same function and connected to the Internet 200 and the storage device 300 for retrieving, from for example the Internet 200, data of optimum direction and elevation angle for the antenna receiving signal from a transmission terminal of an artificial satellite, a digital TV station, and a digital broadcasting station, based on which adjustment of direction and elevation angle of the digital antenna unit 10 can be done. The storage device 300 serves to record video data and stores data of the optimum direction and elevation of the digital antenna unit 10 for signal receiving. The storage device 300 receives the direction signal S1 from the trafficator 20, the digital video image signal S3 and the intensity quality signal S4 from demodulator 40 and supplies the control signal S5 to the demodulator 40, for realizing the function of feedback-based automatic adjustment device of the digital antenna unit 10 by the adjustment device 100 described with reference to FIGS. 1-4.

The automatic feedback adjustment device for digital antenna described herein with reference to FIGS. 1-6 is provided for explanation of the principle of the present invention, not to limit the scope of present invention, which is only interpreted by reading the appended claims. And although the present invention has been described with reference to the preferred embodiments thereof, it is apparent to those skilled in the art that a variety of modification and changes may be made without departing from the scope of the present invention which is intended to be defined by appended claims.

What is claimed is:

1. An automatic feedback adjustment device for a digital antenna, comprising:

a digital antenna unit;

a trafficator connected to the digital antenna unit to retrieve actual direction and elevation angle of the digital antenna unit and, based on which, generates a direction signal;

a tuner connected to the digital antenna unit for selecting a channel to receive a digital video/broadcasting signal from a transmission terminal and supplies a transmission signal;

a demodulator connected to the tuner for controlling the tuner selecting the channel to convert the transmission signal from the tuner into a digital video image signal and a signal intensity quality signal and output the digital video image signal and the signal intensity quality signal;

an antenna direction driver unit connected to the digital antenna unit for driving adjustment of direction and elevation angle of the digital antenna unit;

a secondary controller connected to the trafficator, the demodulator and the antenna direction drive unit to receive, according to the direction signal from the trafficator, the video image signal and signal intensity quality signal from the demodulator and convert the video image signal into a teleview image data, which is output together with the signal intensity quality signal and the direction signal, the secondary controller issuing at the same time, a control signal to the demodulator, based on which control signal, control over the demodulator and the tuner is performed, the secondary controller issuing a drive control signal to the antenna direction drive unit to control the antenna direction drive unit for driving the direction and the elevation angle of the digital antenna unit; and a primary controller connected to a network, a storage device and the secondary controller to receive data of optimum direction and elevation angle for the antenna receiving signals from transmission terminal through the network and the storage device and issuing an antenna control signal to the secondary controller to serve as a basis for adjusting the direction and the elevation angle of the digital antenna unit, the primary controller converting the teleview image data and the signal intensity quality signal and the direction signal received from the secondary controller into video data and signal quality data, direction data that are stored in the storage device.

2. The automatic feedback adjustment device as claimed in claim 1, wherein the digital antenna unit comprises a digital video/broadcasting antenna system.

3. The automatic feedback adjustment device as claimed in claim 1, wherein the trafficator comprises a direction sensor and an elevation angle sensor.

4. The automatic feedback adjustment device as claimed in claim 3, wherein the direction sensor and the elevation angle sensor comprise photo-electric sensors.

5. The automatic feedback adjustment device as claimed in claim 1, wherein the antenna direction drive unit comprises a direction driver and an elevation angle driver.

6. The automatic feedback adjustment device as claimed in claim 5, wherein the direction driver and the elevation angle driver comprise server motors.

7. The automatic feedback adjustment device as claimed in claim 1, wherein the secondary controller comprises:

a central processor serving as a processing center for the digital video image signal, the direction signal, and the signal intensity quality signal and also serving as control center issuing the control signal and the drive control signal;

a trafficator access interface connected between the trafficator and the central processor for converting and applying the direction signal fed back from the trafficator to the central processor;

a direction driver interface connected between the antenna drive unit and the central processor;

an elevation angle driver interface connected between the antenna direction drive unit and the central processor;

a demodulator access interface connected between the demodulator and the central processor to apply the digital video image signal and the signal intensity quality signal from the demodulator to the central processor and enabling the central processor to transfer the control signal to the demodulator; and a primary controller connection interface connected to the central processor to enable the central processor to convert the digital video image signal into the teleview image data and the signal intensity quality signal and the direction signal that are outputted through the controller connection interface.

8. The automatic feedback adjustment device as claimed in claim 1, wherein the primary controller comprises:

a central processor serving to process the video image data, the signal intensity quality signal and the direction signal and to supply the antenna control signal;

a network access interface connected between the central processor and the network to retrieves, from the network; data of the optimum direction and elevation for the antenna receiving signals from the transmission terminal;

a data storage device interface connected between the central processor and the storage device to store the teleview image data and the signal intensity quality signal and the direction signal and the data of the optimum direction and elevation angle for the antenna receiving signals from the transmission terminal; and a secondary controller access device connected to the central processor and the secondary controller to receive the teleview image data and the signal intensity quality data from the secondary controller and supply the antenna control signal to the secondary controller.

9. The automatic feedback adjustment device as claimed in claim 1, wherein the primary controller and the secondary controller are integrated as one single integrated controller.

* * * * *